US007934388B2

(12) United States Patent
Yasutomi et al.

(10) Patent No.: US 7,934,388 B2
(45) Date of Patent: May 3, 2011

(54) INDOOR UNIT OF AIR CONDITIONER

(75) Inventors: Masanao Yasutomi, Kusatsu (JP); Masayuki Kojima, Kusatsu (JP); Masuzou Takahashi, Kusatsu (JP); Toshihiro Wakamatsu, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 424 days.

(21) Appl. No.: 12/095,107

(22) PCT Filed: Nov. 21, 2006

(86) PCT No.: PCT/JP2006/323178

§ 371 (c)(1), (2), (4) Date: May 27, 2008

(87) PCT Pub. No.: WO2007/060933

PCT Pub. Date: May 31, 2007

(65) Prior Publication Data

US 2010/0132392 A1 Jun. 3, 2010

(30) Foreign Application Priority Data

Nov. 28, 2005 (JP) ..... 2005-341873

(51) Int. Cl.
*F25D 21/14* (2006.01)

(52) U.S. Cl. ..... 62/285; 62/291

(58) Field of Classification Search ..... 62/291, 62/419, 262, 263, 259.1, 272, 285, 289
See application file for complete search history.

(56) References Cited

U.S. PATENT DOCUMENTS

| | | | | |
|---|---|---|---|---|
| 6,658,882 | B2 * | 12/2003 | Ohama et al. | 62/262 |
| 6,925,831 | B2 * | 8/2005 | Park et al. | 62/262 |
| 2003/0029184 | A1 * | 2/2003 | Ohama et al. | 62/262 |
| 2004/0168461 | A1 * | 9/2004 | Park et al. | 62/262 |
| 2005/0086963 | A1 * | 4/2005 | Lee | 62/259.1 |

FOREIGN PATENT DOCUMENTS

| | | | |
|---|---|---|---|
| CN | 1629547 | A | 6/2005 |
| JP | 60-121125 | U | 8/1985 |
| JP | 7-208757 | A | 8/1995 |
| JP | 08-014596 | A | 1/1996 |
| JP | 10-259928 | A | 9/1998 |
| JP | 2005-180814 | A | 7/2005 |

* cited by examiner

*Primary Examiner* — Mohammad M Ali
(74) *Attorney, Agent, or Firm* — Birch, Stewart, Kolasch & Birch, LLP

(57) ABSTRACT

Grooves are formed on a back surface 22 of a tongue part 21 of a rear plate 3 which surface does not guide a flow of air.

2 Claims, 4 Drawing Sheets

INDOOR UNIT OF AIR CONDITIONER

TECHNICAL FIELD

The present invention relates to an indoor unit of an air conditioner.

BACKGROUND ART

In a conventional indoor unit of an air conditioner, a rear drain pan for receiving drain from a rear side heat exchanger is provided on a rear plate that is placed on rear side of a blower fan and that guides to a blowoff opening air having passed through a front and the rear side heat exchangers (e.g., JP 8-14596 A).

In an indoor unit of an air conditioner, which is not shown, a rear plate of the unit is molded in one piece so as to have a cross-section generally shaped like a letter Y, and a rear drain pan is formed of a portion of the plate which has the Y-shaped cross-section. Specifically, the rear plate is composed of facing part that faces a blower fan and protruding part that protrudes rearward from lower end of tongue part that is upper end part of the facing part, and the rear drain pan formed of the tongue part and of the protruding part is molded in one piece from resin, so that production cost therefor is reduced.

Incidentally, the rear plate is molded with use of a lower metal mold that has a large cross-sectional area and that is for molding a front side of the facing part for guiding air and an upper metal mold that has a small cross-sectional area and that is for molding an inner surface of the rear drain pan. The lower metal mold having the large cross-sectional area and thus allowing penetration therethrough of a large number of cooling pipes can sufficiently be cooled by those pipes, whereas the upper metal mold having the small cross-sectional area and thus allowing penetration therethrough of few cooling pipes cannot be cooled sufficiently, which causes a great difference in temperature between resin part of the tongue part in contact with the lower metal mold and resin part of the tongue part in contact with the upper metal mold. The great temperature difference results in a problem in that an excessive residual stress in the tongue part that is the upper end part of the rear plate may cause a warp of the upper end part of the rear plate after release of the molds.

SUMMARY OF THE INVENTION

It is a primary object of the present invention to provide an indoor unit of an air conditioner that is capable of preventing occurrence of a warp in upper end part of a rear plate.

In order to achieve the object, an indoor unit of an air conditioner of the invention comprises:

a blower between a heat exchanger and a blowoff opening, and a rear plate for guiding a flow of air toward the blowoff opening, the rear plate placed on back side of the blower, wherein grooves are provided on a back surface of windward end part of the rear plate opposed to a front surface of the windward end part which guides the flow of air.

In the specification, terms "upper," "lower," "front," "rear" or "vertical direction" designate upper, lower, front, rear or vertical direction in an installed indoor unit of an air conditioner (the air conditioner that is running).

In the invention, the grooves that are formed on the back surface of the windward end part of the rear plate opposed to the front surface increase a surface area of the back surface (a heat radiating area in contact with air) and thus promote heat radiation from the back surface having the grooves formed thereon. On condition that a temperature on the back surface of the end part is higher than a temperature on the front surface of the end part when the end part is formed, accordingly, a temperature difference can be decreased between the temperature on the back surface and the temperature on the front surface, and a residual stress in the end part can be reduced that is caused by the temperature difference. As a result, warp in the end part can be reduced.

In the invention, the grooves are formed on the back surface, and thus rigidity of the end part can be increased by the grooves. In this respect also, accordingly, the warp in the end part can be reduced.

In one embodiment, the end part of the rear plate forms a portion of a rear drain pan that is molded integrally with the rear plate, and wherein the back surface having the grooves is an inside surface of the rear drain pan.

In molding of the rear plate according to the embodiment in which an upper metal mold is placed inside the rear drain pan and in which a lower metal mold is placed on the front surface of the rear plate that guides the flow of air, even if a large residual stress tends to occur in the end part because of excess of a temperature of the upper metal mold having a small cross-sectional area over a temperature of the lower metal mold having a large cross-sectional area and allowing penetration therethrough of a large number of cooling pipes, the grooves inside the rear drain pan that effect radiation of a large quantity of heat from the back surface immediately after mold release allow the residual stress in the end part to be efficiently relieved. As a result, warp in the end part can effectively be reduced.

In one embodiment, the grooves extend in a direction generally perpendicular to a rotation axis of the blower.

In the embodiment, the grooves extend in the direction generally perpendicular to the rotation axis of the blower, therefore the grooves can efficiently be formed, and the surface area of the back surface of the end part can be increased. Provided that the back surface forms part of the rear drain pan, drain can be moved downward and dripped along the grooves and can smoothly be collected.

In an indoor unit of an air conditioner of the invention, the grooves that are formed on the back surface of the windward end part of the rear plate opposed to the front surface which guides a flow of air increase a surface area of the back surface and thus promote heat radiation from the back surface having the grooves formed thereon. On condition that a temperature on the back surface which does not guide the flow of air of the end part is higher than a temperature on the front surface which guides the flow of air of the end part when the end part is formed, accordingly, a temperature difference can be decreased between the temperature on the back surface and the temperature on the front surface, and a residual stress in the end part can be reduced that is caused by the temperature difference. As a result, warp in the end part can be reduced.

In an indoor unit of an air conditioner of the invention, the grooves are formed on the back surface, and thus rigidity of the end part can be increased by the grooves. In this respect also, accordingly, the warp in the end part can be reduced.

In an indoor unit of an air conditioner in accordance with an embodiment, the end part of the rear plate forms part of the rear drain pan, the back surface having the grooves forms the inside surface of the rear drain pan made in one piece, therefore quantity of heat radiated from the back surface can be increased by the grooves immediately after mold release and decrease in residual stress and reduction in warp in the end part can be achieved even though a cross-sectional area of a metal mold for molding inside of the rear drain pan is small.

In an indoor unit of an air conditioner in accordance with an embodiment, the grooves extend in the direction generally perpendicular to the rotation axis of the blower, that is, in the direction in which metal molds are put in and out, and thus the grooves can easily be formed. In the unit in which the back surface forms part of the rear drain pan, drain can be moved and dripped along the grooves and can smoothly be collected.

DETAILED DESCRIPTION OF THE INVENTION

Embodiments of the invention will now be described in detail with reference to the accompanying drawings.

Figure 1:
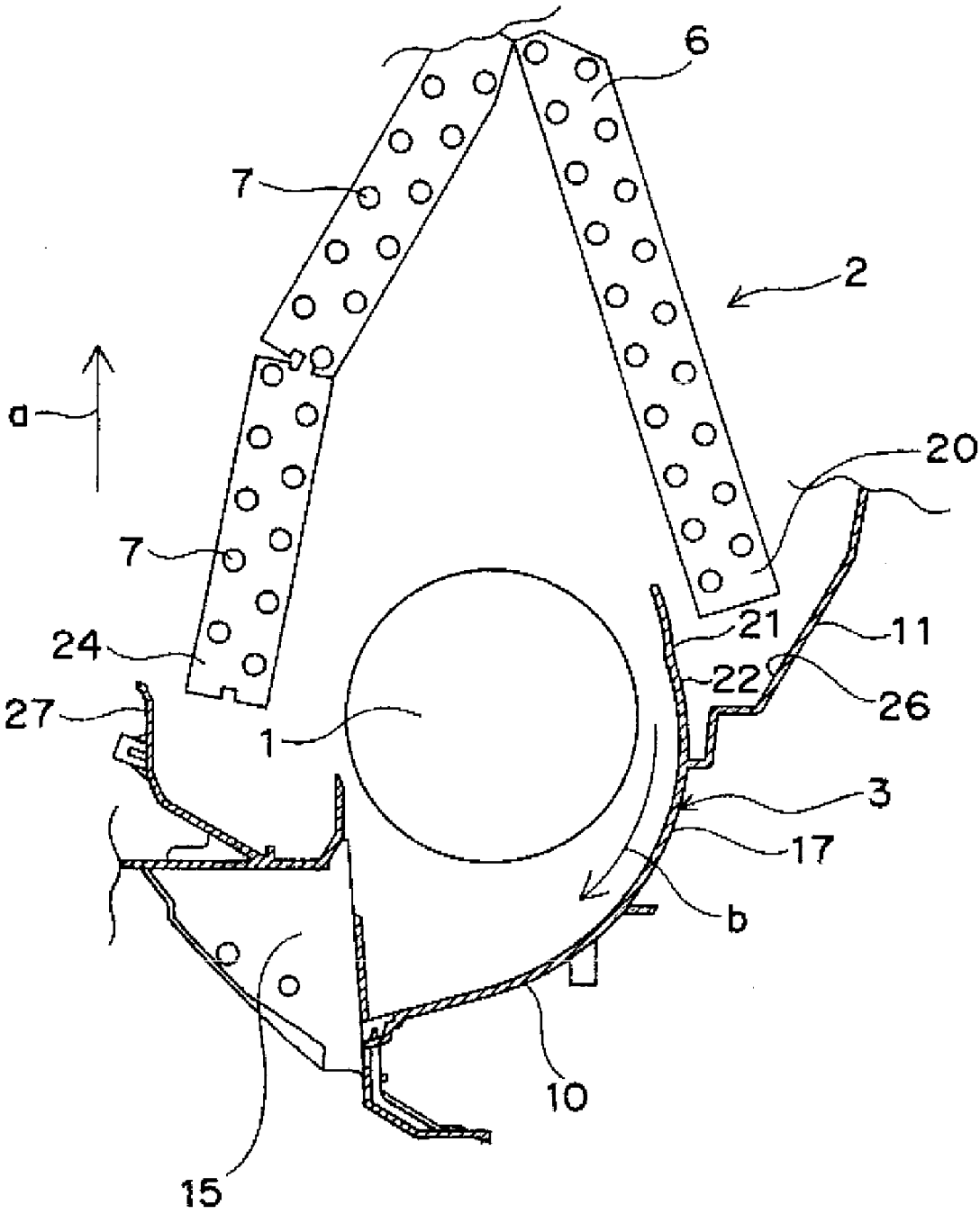
FIG. 1 is a schematic vertical section view of an indoor unit of an air conditioner in accordance with an embodiment of the invention.

FIG. 1 is a schematic vertical section view of an indoor unit of an air conditioner in accordance with an embodiment of the invention. In FIG. 1, reference number 1 denotes a cross flow fan as an example of a blower, number 2 denotes a heat exchanger composed of a front side heat exchanger and a rear side heat exchanger, and number 3 denotes a rear plate. In FIG. 1, an arrow a designates an upward vertical direction. The cross flow fan 1 is placed between the heat exchanger 2 and a blowoff opening 15.

The heat exchanger 2 has fins 6 and heat transfer tubes 7. A plurality of fins 6 are disposed at specified intervals along a direction perpendicular to a page of FIG. 1. The fins 6 are shaped like flat plates. The fin 6 has a configuration that is bent generally like a letter V such that upper part thereof with respect to the vertical direction shown by the arrow a in FIG. 1 protrudes. The heat transfer tubes 7 extend generally in a direction of a normal to the fin 6. Specifically, the heat transfer tubes 7 extend so as to penetrate the plurality of fins 6 placed at the specified intervals along the direction of the normal to the page. Inside the heat transfer tubes 7 is circulated fluid. The heat exchanger 2 effects heat exchange between the fluid circulated inside the heat transfer tubes 7 and air circulated outside the heat transfer tubes 7.

The rear plate 3 is molded in one piece from resin. The rear plate 3 has a main body 10 and a protrusion 11. The main body 10 is shaped like a curved plate and extends from upper side to the blowoff opening 15 on lower side in the vertical direction so as to face the cross flow fan 1, in other words, so as to cover rear side of the cross flow fan 1. The main body 10 guides air in a direction shown by an arrow b in FIG. 1 which air has passed through the heat exchanger 2 and has undergone heat exchange. The protrusion 11 has a plate-like shape (a term "plate" in the specification encompasses curved plates, plates having one or more bends, and plates having curved parts and bent parts). The protrusion 11 protrudes from a back surface 17 of the main body 10 which surface does not guide the air. Specifically, the protrusion 11 protrudes from between both ends (from a site other than both the ends) of the back surface 17. The protrusion 11 extends generally upward in the vertical direction while being bent several times in the cross-section shown in FIG. 1.

An end 20 of the rear side heat exchanger of the heat exchanger 2 on side of the rear plate 3 is positioned between a tongue part (windward end part of the rear plate 3) 21 of the main body 10, which part is above the protrusion 11, and the protrusion 11. The tongue part 21 and the protrusion 11 serve as a rear drain pan 26. In other words, the tongue part 21 and the protrusion 11 form part of a drain receiving section of a drainage system for discharging drain coming from the end 20 of the rear side heat exchanger on the side of the rear plate 3.

A plurality of grooves (not shown in FIG. 1) are formed on a back surface 22 opposed to a front surface, which guides air, of the windward end part 21 of the rear plate 3, that is, on the back surface 22 opposed to the front surface of the tongue part 21 which guides air. The plurality of grooves are formed and spaced with specified intervals in the direction perpendicular to the page of FIG. 1. Each groove extends in a vertical direction with respect to the indoor unit of the air conditioner, that is, in the direction generally perpendicular to a rotation axis of the cross flow fan 1.

The back surface 22 having the grooves forms an inner surface of the rear drain pan 26. Reference number 27 denotes a front drain pan, which will not be described in detail. The front drain pan 27 has a shape convexed downward in the cross-section of FIG. 1, and a front and lower end 24 of the front side heat exchanger of the heat exchanger 2 is positioned above the front drain pan 27. The front drain pan 27 forms part of a drain receiving section of a drainage system for discharging drain coming from the front and lower end 24 of the front side heat exchanger.

In the air conditioner, the cross flow fan 1 is rotated, the air that has been sucked in through the heat exchanger 2 and that has undergone heat exchange is made to flow in the direction shown by the arrow b, along the main body 10 of the rear plate 3, and is guided in a direction toward the blowoff opening 15, and the air having undergone heat exchange is blown out from the blowoff opening 15. In cooling operation, drain is produced in the heat exchanger 2 and then drips down. On this occasion, the front drain pan 27 receives drain dripping down from the front and lower end of the heat exchanger 2, and the rear drain pan 26 receives drain from the end 20 of the heat exchanger 2 on the side of the rear plate 3 (the rear and lower end of the heat exchanger 2), so that drainage treatment is performed in a lump.

Figure 2:
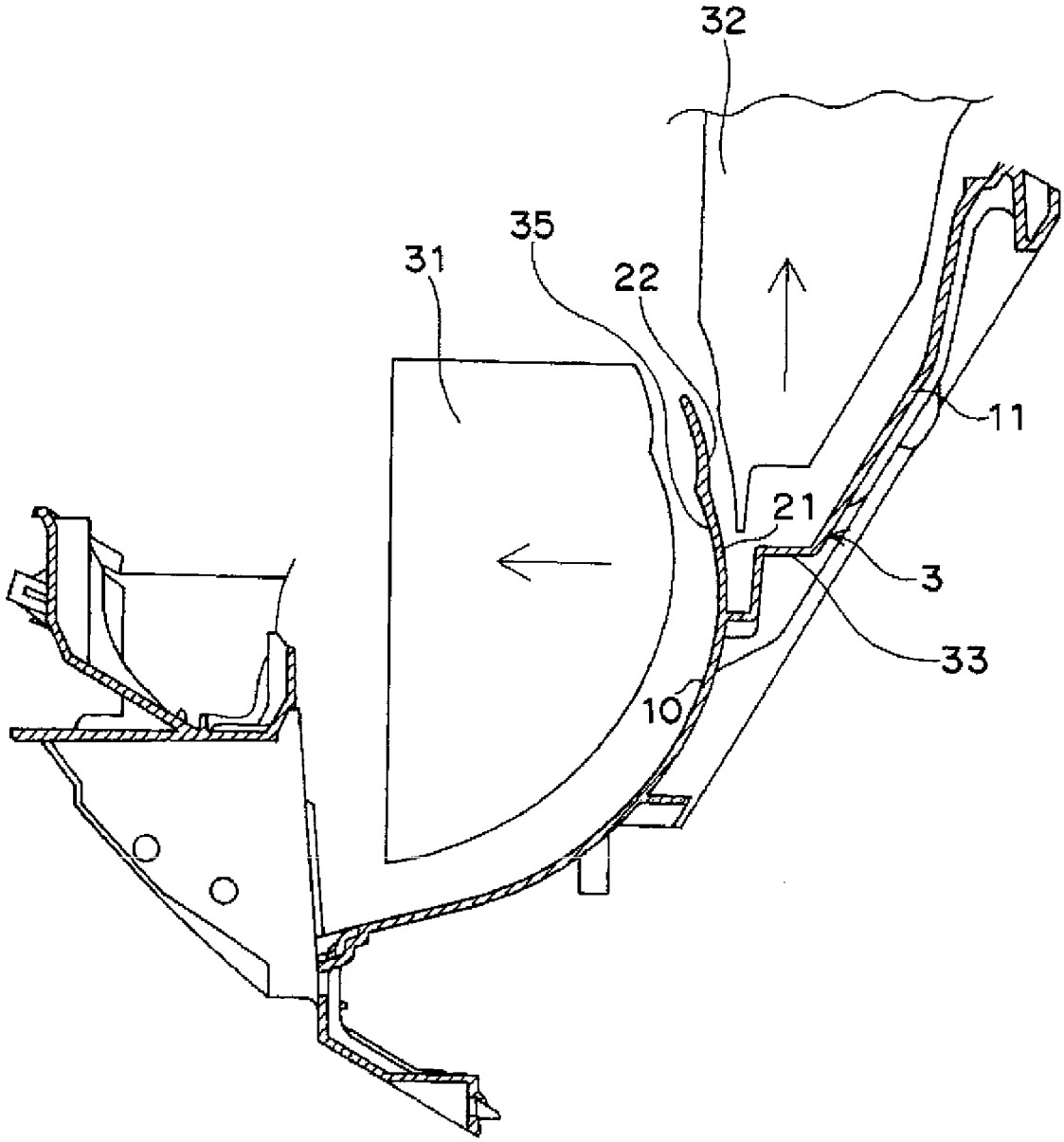
FIG. 2 is a cross-section view showing an arrangement of metal molds on occasion of integral molding of a rear plate that the indoor unit of the air conditioner has.

FIG. 2 is a cross-section view showing an arrangement of metal molds on occasion of integral molding of the rear plate 3.

In FIG. 2, reference number 31 denotes a lower metal mold placed on side of the front surface that guides a flow of air on the main body 10 of the rear plate 3, and number 32 denotes an upper metal mold placed between the back surface 22 of the tongue part 21 and the protrusion 11. Arrows shown in FIG. 2 designate directions in which the lower metal mold 31 and the upper metal mold 32 are moved on occasion of mold release. The rear plate 3 is molded in one piece from resin. Specifically, the rear plate 3 is formed through processes of assembling the lower metal mold 31, the upper metal mold 32, and a back side metal mold (not shown) placed on side of a surface 33 of the rear plate 3 opposed to the tongue part 21 side, thereby forming a space having a shape corresponding to the rear plate 3 among the lower metal mold 31, the upper metal mold 32, and the back side metal mold, pouring liquid resin into the space, and curing the poured liquid resin.

When the rear plate 3 having the tongue part 21 is molded in one piece with use of the three metal molds, there is caused a necessity to cool the metal molds in order to cure the resin. This is achieved with the metal molds cooled by cooling pipes (not shown) that are penetrated through the metal molds in a direction perpendicular to a page of FIG. 2. The lower metal mold 31 being placed on lower side, having a large cross-sectional area and allowing penetration therethrough of a large number of cooling pipes can sufficiently be cooled, whereas the upper metal mold 32 being placed on upper side, having a small cross-sectional area and allowing penetration therethrough of few cooling pipes cannot be cooled sufficiently, which causes a difference in temperature between resin part of the tongue part 21 in contact with the lower metal mold 31 and resin part of the tongue part 21 in contact with the upper metal mold 32, before mold release. In the indoor unit of the air conditioner in accordance with the embodiment, however, in which the plurality of grooves are formed on the back surface 22 of the tongue part 21 opposed to the front surface guiding a flow of air so as to increase a surface area of the back surface 22 (heat radiating area in contact with air) as described above, the back surface 22 radiates a large quantity of heat per unit time and thus relieves the temperature difference, from immediately after the mold release. Correctly, a quantity of heat radiated from the back surface 22 per unit time exceeds a quantity of heat radiated per unit time from the front surface of the tongue part 21 that guides a flow of air, and the temperature difference is thereby relieved, since immediately after the mold release until temperatures in the tongue part 21 are made generally uniform. This prevents occurrence of a great temperature difference between the front surface 35 of the tongue part 21 which surface guides the flow of air and the back surface 22 of the tongue part 21 which surface does not guide the flow of air and thus prevents occurrence of undesired warp in the tongue part 21 after the mold release.

Figure 3A:
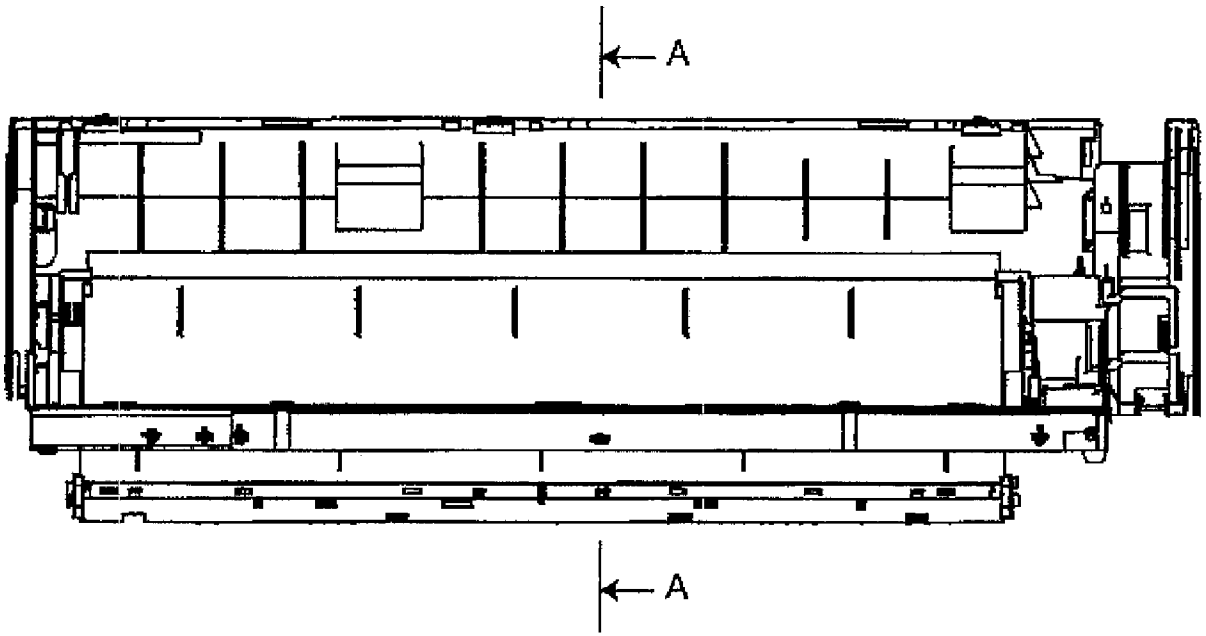
FIG. 3A is a view of the indoor unit of the air conditioner in accordance with the embodiment as seen from rear side.
Figure 3B:
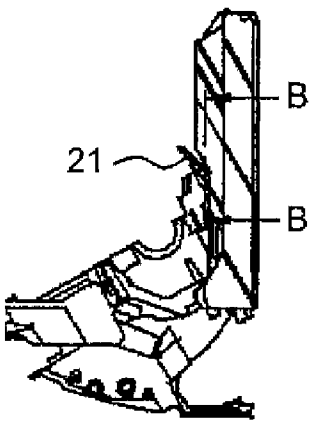
FIG. 3B is a cross-section view of part of the indoor unit of the air conditioner, taken along line A-A in FIG. 3A.
Figure 3C:
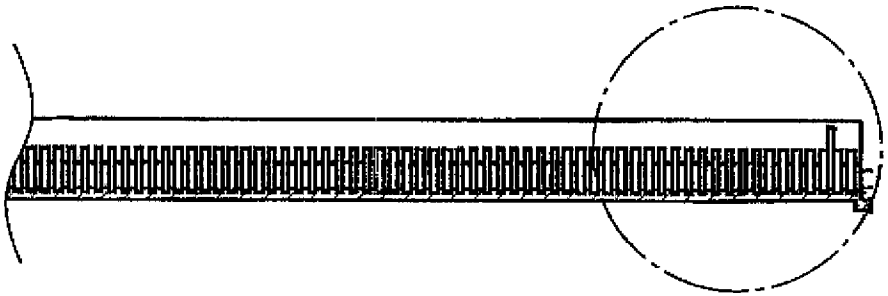
FIG. 3C is a cross-section view taken along line B-B in FIG. 3B.
Figure 3D:
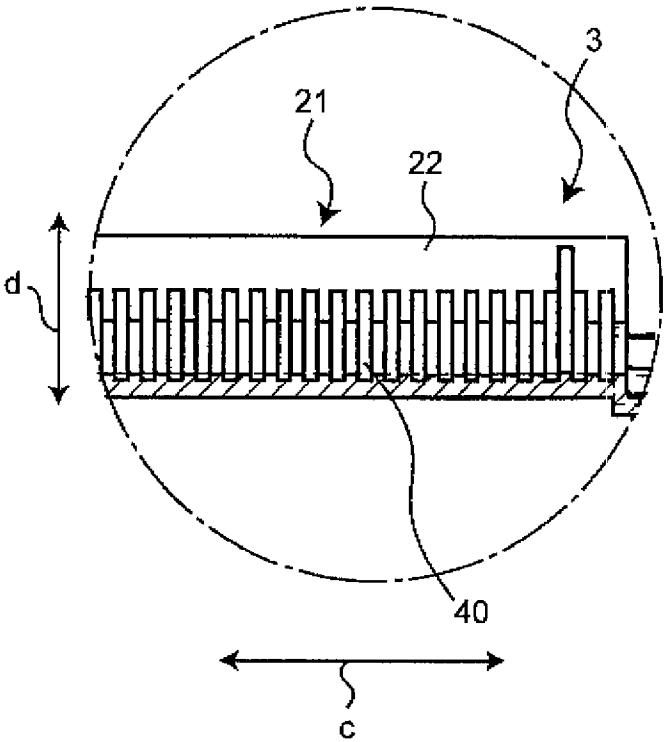
FIG. 3D is an enlarged fragmentary view of FIG. 3C.

FIG. 3A is a view of the indoor unit of the air conditioner in accordance with the embodiment as seen from rear side, and FIG. 3B is a cross-section view of part of the indoor unit of the air conditioner, taken along line A-A in FIG. 3A. FIG. 3C is a cross-section view taken along line B-B in FIG. 3B, and FIG. 3D is an enlarged fragmentary view of FIG. 3C. In FIG. 3B, reference number 21 denotes the tongue part 21. As shown in FIG. 3D, the plurality of grooves 40 are formed on the back surface 22 of the tongue part 21 of the rear plate 3 which surface does not guide the flow of air. The plurality of grooves 40 are spaced and placed with specified intervals in a longitudinal direction with respect to the indoor unit of the air conditioner which direction is shown by an arrow c in FIG. 3D (corresponding to the direction perpendicular to the page of FIG. 1). The grooves 40 extend in the vertical direction with respect to the indoor unit of the air conditioner which direction is shown by an arrow d in FIG. 3D.

In the indoor unit of the air conditioner in accordance with the embodiment, the grooves 40 formed on the back surface 22 of the tongue part 21 (the windward end part of the rear plate 3) opposed to the air blow guiding side increase the surface area of the back surface 22 (the heat radiating area in contact with air) and thus promote heat radiation from the back surface 22. On condition that a temperature on the back surface 22 of the tongue part 21 which surface does not guide the flow of air is higher than a temperature on the front surface of the tongue part 21 which surface guides the flow of air, in taking out the tongue part 21, accordingly, the temperature difference can be decreased between the temperature on the back surface 22 which does not guide the flow of air and the temperature on the front surface which guides the flow of air, and a residual stress in the tongue part 21 can be reduced that is caused by the temperature difference. As a result, warp in the tongue part 21 can be reduced.

In the indoor unit of the air conditioner in accordance with the embodiment, which has the grooves 40 formed on the back surface 22 of the tongue part 21 that does not guide the flow of air, rigidity of the tongue part can be increased by the grooves 40. In this respect also, accordingly, the warp in the tongue part 21 can be reduced.

Even if a large residual stress is caused in the tongue part 21 during molding of the rear plate 3 by excess of a temperature of the upper metal mold 32 in contact with the back surface 22 of the tongue part 21 which surface receives drain over a temperature of the lower metal mold 31 in contact with the front surface 35 of the tongue part 21 which surface does not receive the drain (the front surface of the tongue part 21 which guides the flow of air), in the indoor unit of the air conditioner in accordance with the embodiment, the large quantity of heat radiated from the back surface 22 of the tongue part 21 immediately after the mold release allows the residual stress in the tongue part 21 to be efficiently relieved. As a result, the effect of reducing warp in the tongue part 21 is increased.

In the indoor unit of the air conditioner in accordance with the embodiment, in which the grooves 40 extend in the direction generally perpendicular to the rotation axis of the cross flow fan 1, the grooves 40 can efficiently be formed and the surface area of the back surface 22 of the tongue part 21 can be increased. Besides, drain can be moved along the grooves 40 and can smoothly be collected because the grooves 40 extend in the direction generally perpendicular to the rotation axis of the cross flow fan 1. Furthermore, the grooves 40, which extend in the direction in which the metal molds are put in and out, can easily be formed.

In the indoor unit of the air conditioner in accordance with the embodiment, the rear plate 3 that is combinedly provided with a function of the rear drain pan and that has a function of guiding the flow of air to the blowoff opening and the function of the rear drain pan is molded in one piece. In the invention, however, the rear plate having the grooves formed on the windward end part thereof and the rear drain pan do not have to be formed in one piece and may be formed independently.

In the indoor unit of the air conditioner in accordance with the embodiment, the grooves 40 are formed on the back surface 22 of the tongue part 21, which surface does not guide the flow of air, so as to extend in the vertical direction with respect to the indoor unit of the air conditioner. In the invention, however, the grooves 40 may be formed on the back surface of the tongue part, which surface does not guide the flow of air, so as to extend in a transverse direction with respect to the indoor unit of the air conditioner. That is, a plurality of grooves may be formed and spaced in the direction of the arrow d in FIG. 3D so as to extend in the direction of the arrow c in FIG. 3D. The grooves may be formed on the back surface of the tongue part, which surface does not guide the flow of air, so as to extend in any direction. As a matter of course, a shape of the grooves formed on the back surface of the tongue part which surface does not guide the flow of air does not have to be linear and may be any shape such as bent shape, curved shape and combination of those.

The invention claimed is:

1. An indoor unit of the air conditioner, comprising:

a blower between a heat exchanger and a blowoff opening, and a rear plate for guiding a flow of air toward the blowoff opening, the rear plate placed on back side of the blower, wherein grooves are provided on a back surface of windward end part of the rear plate opposed to a front surface of the windward end part which guides the flow of air, the end part of the rear plate forms a portion of a rear drain pan that is molded integrally with the rear plate, and the back surface having the grooves is an inside surface of the rear drain pan.

2. The indoor unit of the air conditioner as claimed in claim 1, wherein the grooves extend in a direction generally perpendicular to a rotation axis of the blower.

* * * * *